United States Patent [19]

Weiner et al.

[11] 4,444,101

[45] Apr. 24, 1984

[54] METHOD OF PRINTING LINES ON PLEATED FABRIC

[76] Inventors: Michael Weiner, 8 Darby Rd., Marlboro, N.J. 07746; Jose Grajeda, 1964 Wall St., Rahway, N.J. 07065

[21] Appl. No.: 465,967

[22] Filed: Feb. 14, 1983

[51] Int. Cl.[3] ..... B41F 17/00

[52] U.S. Cl. ..... 101/35; 101/126; 101/129; 101/407 R; 8/482; 68/200; 118/32; 118/44; 211/46

[58] Field of Search ..... 118/32, 44, DIG. 4; 8/482, 486, 487, 115; 68/200, 206; 101/114, 126, 129, 35, 426, 407 R; 211/46

[56] References Cited

U.S. PATENT DOCUMENTS

| | | | |
|---|---|---|---|
| 2,314,757 | 3/1943 | Benedict | 118/32 X |
| 2,785,081 | 3/1957 | Babiarz et al. | 118/44 X |
| 3,205,854 | 9/1965 | Lyons | 118/32 |
| 3,975,151 | 8/1976 | Berg et al. | 8/482 |

*Primary Examiner*—Clifford D. Crowder
*Attorney, Agent, or Firm*—Seidel, Gonda & Goldhammer

[57] ABSTRACT

The ridge of each pleat of pleated fabric is supported by a thin horizontally disposed blade. The blades are moved to a compacted position so that only the ridges are exposed above the blades. Then the ridges are printed with a pigment which is then cured. Thereafter the fabric is removed from the blades.

10 Claims, 8 Drawing Figures

FIG. 1
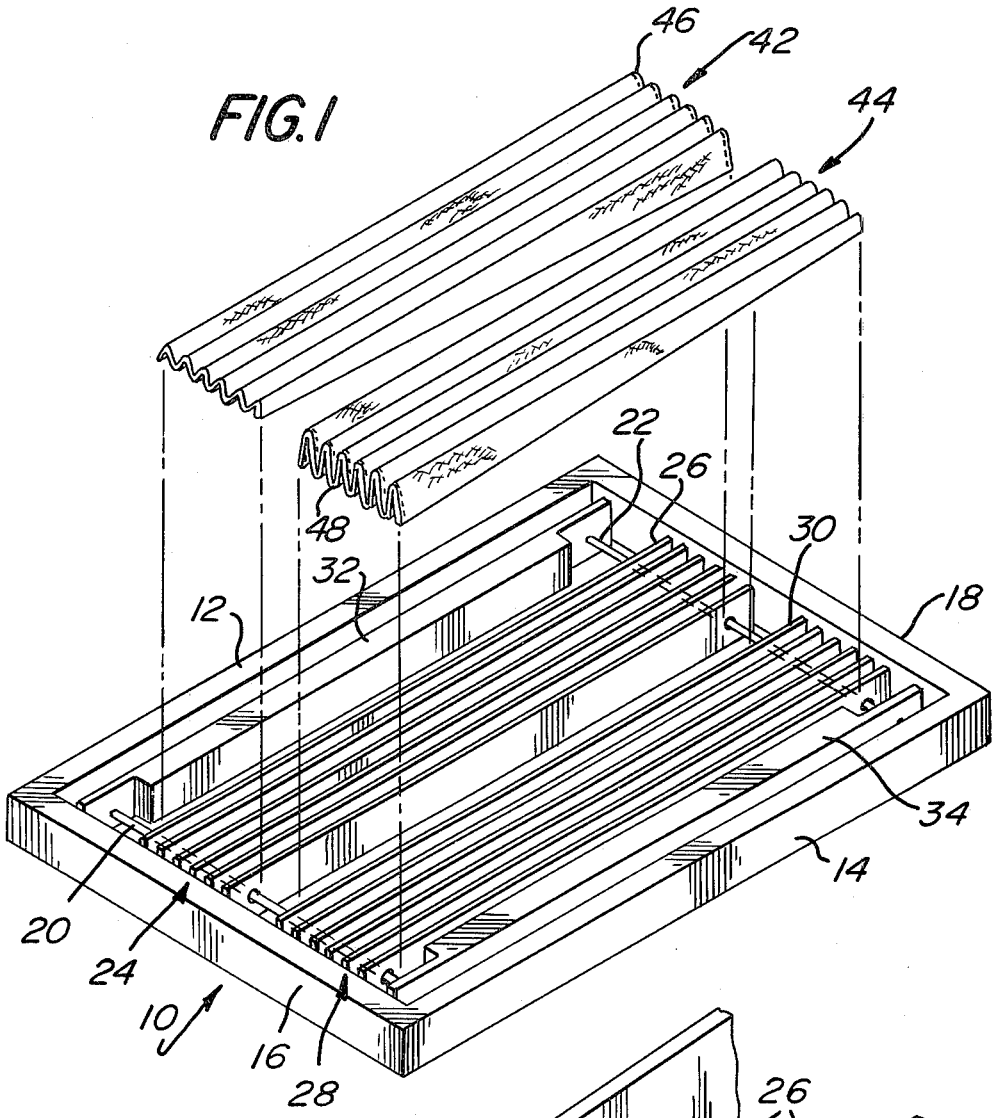
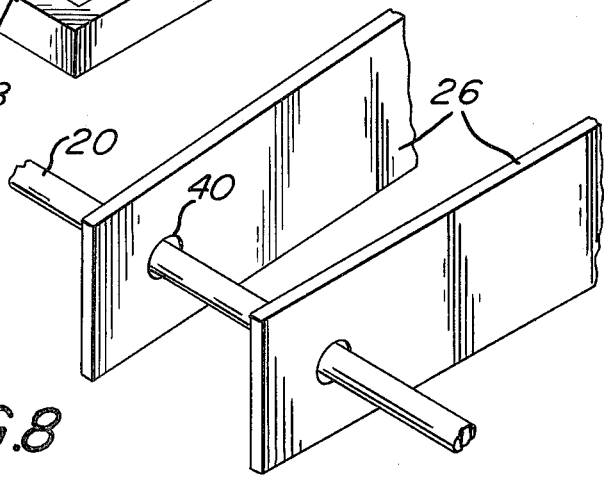
FIG. 8

FIG. 2
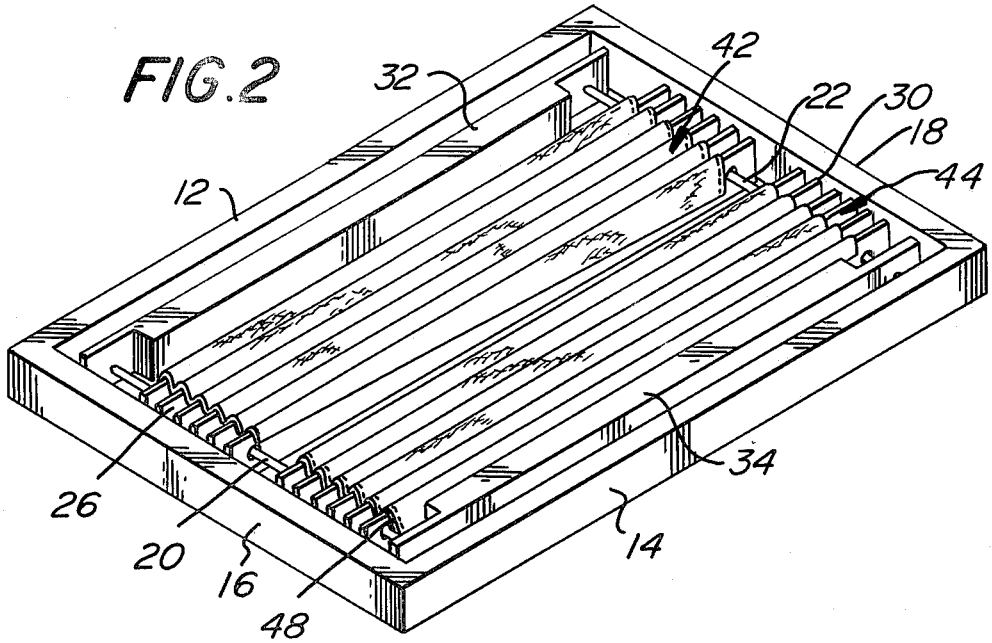
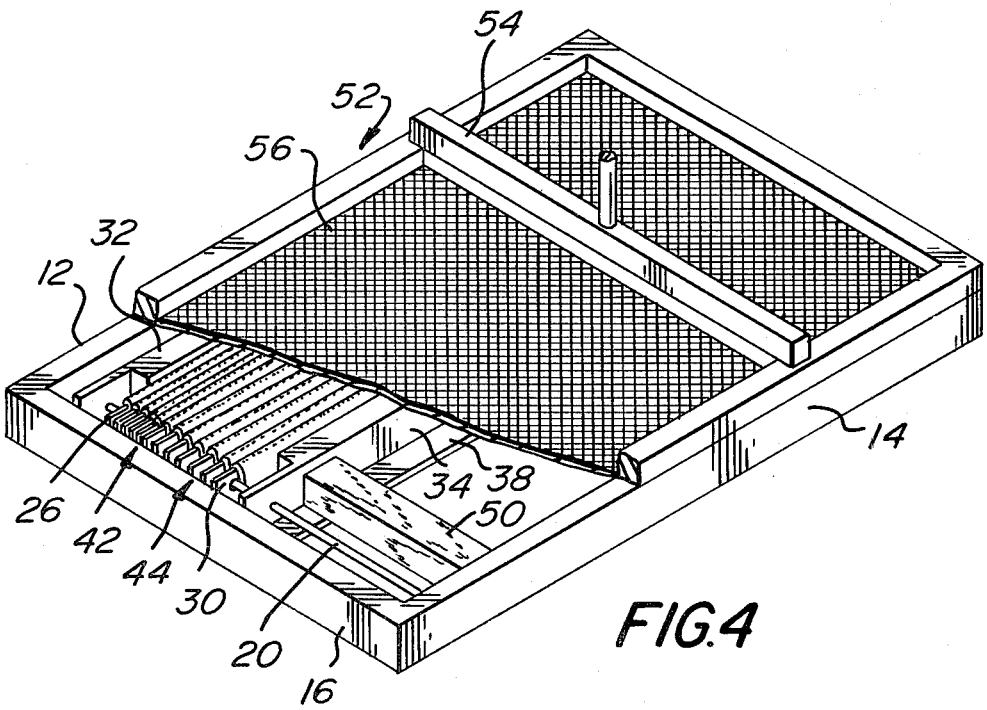
FIG. 4

FIG. 3
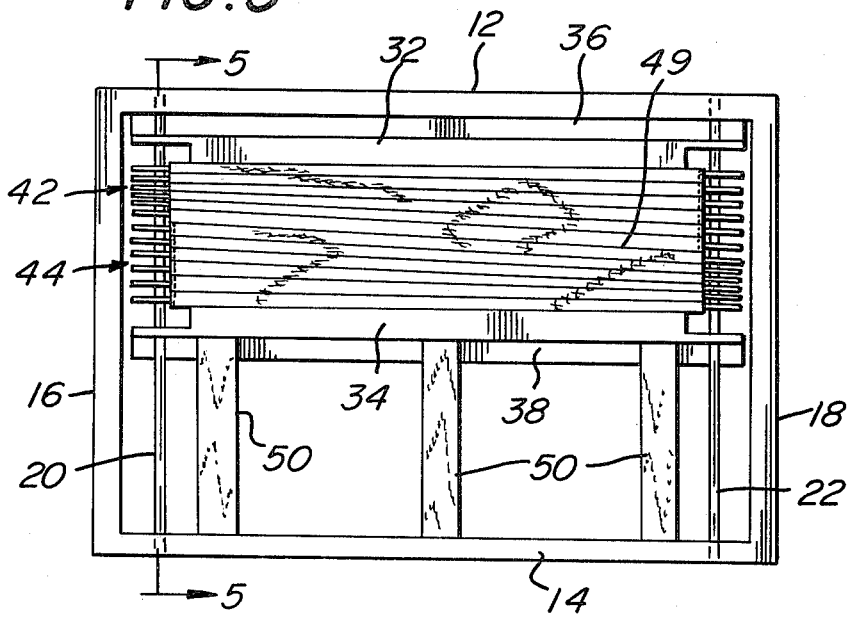
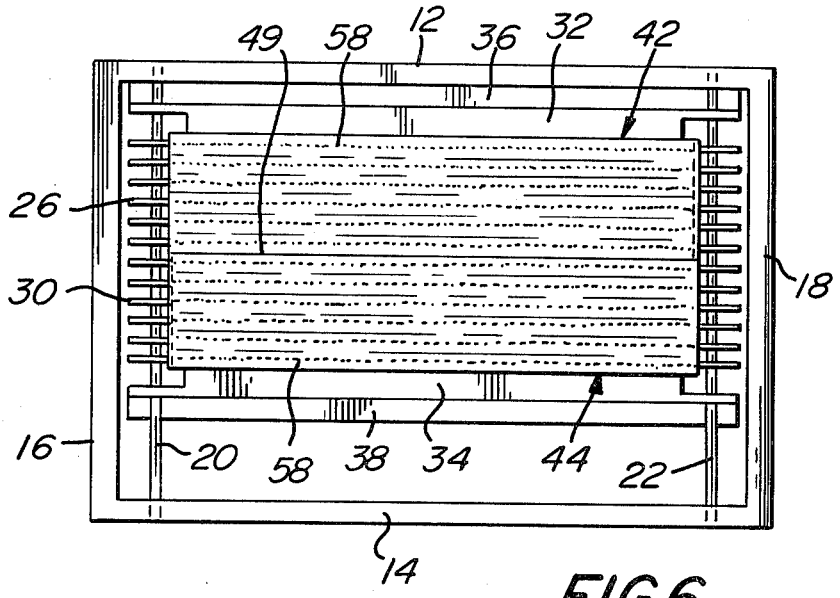
FIG. 6

METHOD OF PRINTING LINES ON PLEATED FABRIC

BACKGROUND OF THE INVENTION

The present invention is directed to a solution of the problem of how to apply converging lines on the ridges of pleats in a pleated fabric such as a woman's skirt.

SUMMARY OF THE INVENTION

The present invention is directed to a method of printing lines on pleated fabric or the like. The pleated fabric is supported by a plurality of thin horizontally disposed blades corresponding in number to the number of pleats. The ridge of each pleat is supported along the upper edge of a blade while the blades are spaced apart from each other. Thereafter, the blades are moved towards each other to a compacted position so that only the ridges of the pleats are exposed above the blades. Thereafter, a pigment is printed on the exposed ridges. Thereafter, the blades are spaced apart and the pigment is cured. Thereafter, the fabric is removed off the blades.

It is an object of the present invention to provide a novel method for printing lines on fabric or the like.

It is another object of the present invention to provide a method and apparatus for applying converging lines to the pleats of a woman's skirt.

Other objects and advantages of the present invention will appear hereinafter.

For the purpose of illustrating the invention, there is shown in the drawings a form which is presently preferred; it being understood, however, that this invention is not limited to the precise arrangements and instrumentalities shown.

FIG. 1 is a perspective exploded view of a frame beneath a pair of discrete pleated fabrics.

FIG. 2 is a perspective view of the frame supporting the fabrics.

FIG. 3 is a top plan view of the frame after the blades have been moved to a compacted position.

FIG. 4 is a perspective view of the apparatus as shown in FIG. 3 beneath a silk screen printing frame.

FIG. 6 is a top plan view of the frame and fabrics wherein printed lines are ready for drying.

FIG. 8 is a partial perspective view of two adjacent blades on the frame and an associated guide rod.

DETAILED DESCRIPTION

Figure 5:
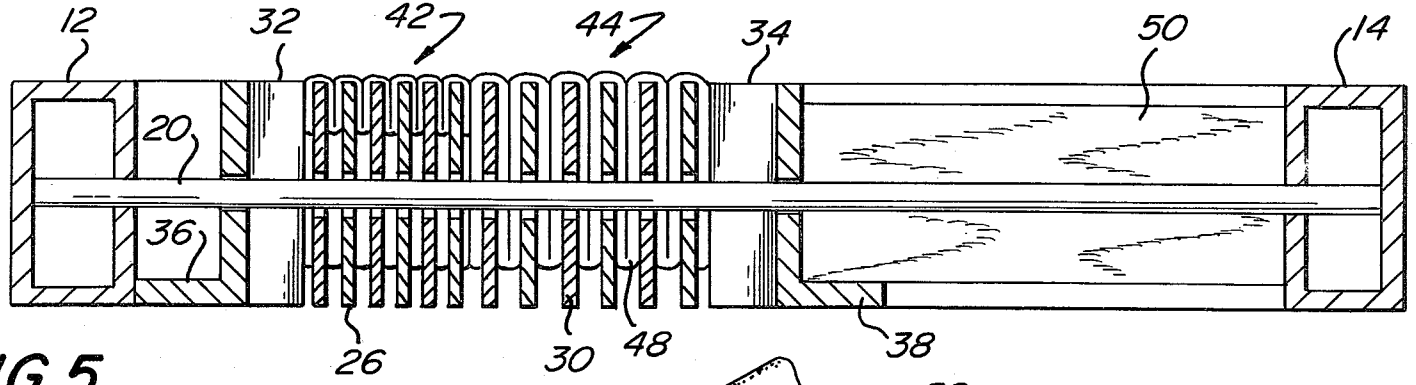
FIG. 5 is a sectional view taken along the line 5—5 in FIG. 3.

Referring to the drawing in detail, wherein like numerals indicate like elements, there is shown in FIG. 1 a frame 10 having sides 12 and 14 interconnected with ends 16 and 18. The frame 10 is preferably hollow but may be made solid if desired.

A pair of rods 20, 22 extend between the sides 12 and 14 at a location adjacent the ends 16 and 18 respectively. A group 24 of blades 26 extend between the ends 16, 18 and are supported by the rods 20, 22. While the blades 26 are horizontally disposed, they are upright so that they have an upper edge. The blades 26 are preferably made from thin metal such as low carbon steel having a thickness of about 0.033–0.035 inches. The blades 26 are supported by and movable along the rods 20, 22.

A second group 28 of blades 30 are supported by the rods 20, 22. Blades 30 are identical with blades 26. Thus, frame 10 has a plurality of even numbered groups of blades. For purposes of illustration only two groups of blades are shown. For purposes of illustration, each group includes 6 blades. In connection with an operative embodiment of the invention wherein lines are printed on a woman's skirt, each group includes 38 blades.

Between group 24 and the side 12 there is provided a rigid end blade 32 which is substantially thicker in the central portion thereof than blades 26. The ends of blade 32 are preferably of reduced thickness as illustrated. A suitable thickness for the central portion of end blade 32 is 13 mm. Between group 28 and side 14, there is provided a similar rigid end blade 34. As shown more clearly in FIG. 5, blade 32 has a flange 36 extending to and in contact with the side 12. Likewise, the blade 34 has a flange 38 at its lower end and extending away from the blades 26, 30.

As shown more clearly in FIG. 8, each of the blades has a hole 40 through which the guide rod 22 extends. The diameter of the hole 40 is greater than the diameter of the rod 22 whereby the blades may be perpendicular to rod 22 or inclined with respect to rod 22 for a purpose to be made clear hereinafter.

Referring to FIG. 1, the frame 10 is illustrated for use with two discrete pleated fabrics 42, 44. The fabrics may be preformed skirts, dresses, blouses, longewear, drapes, etc. The number of pleats on fabric 42 corresponds to the number of blades 26. The number of pleats on fabric 44 corresponds to the number of blades 30. The fabrics 42, 44 are supported by the blades 26, 30 respectively while the blades are spaced apart with each pleat ridge on a blade and two thickness of fabric between adjacent blades. See FIG. 5. Fabric 42 has a hem 46 at one end adjacent the side 18. Fabric 44 has a hem 48 adapted to be adjacent the end 16 of the frame. See FIG. 2. In FIG. 2, all of the blades are parallel to one another.

After each ridge of each pleat is supported by the upper edge of one of the blades, the blades are moved toward one of the end blades such as blade 32. Due to the hems 46, 48, the parting line 49 between the fabrics 42, 44 is angled. See FIG. 3. Each of the blades 26, 30 is slightly angled except for the ones in contact with the end blades 32, 34. It will be noted that the resultant arrangement of fabrics 42, 44 is a parallel arrangement for the end blades as shown in FIG. 3. Thereafter, retainers 50 are applied so as to maintain all of the blades in contact with their associated fabrics with only the ridges of the pleats being exposed above the blades 26, 30. The retainers 50 may be in the form of wooden blocks. The retainers 50 are located in the middle and adjacent the ends of the end blade 34. In place of wooden blocks equivalent devices such as a pair of rods connected by a turn buckle may be utilized.

In the form illustrated in FIG. 3 and as described above, the frame is transported to a position beneath a printing frame as shown in FIG. 4. FIG. 4 shows a silk screen printing frame 52 having a squeegee 54. A pigment applied to the screen 56 is printed on the exposed ridges of the pleats. A mask not shown blocks off any unused portion of screen 56. In place of a silk screening frame, other types of printing frames may be utilized such as a contact printing frame wherein pigment is transferred by sublimation onto the ridges of the pleats from a paper due to pressure and heat.

Figure 7:
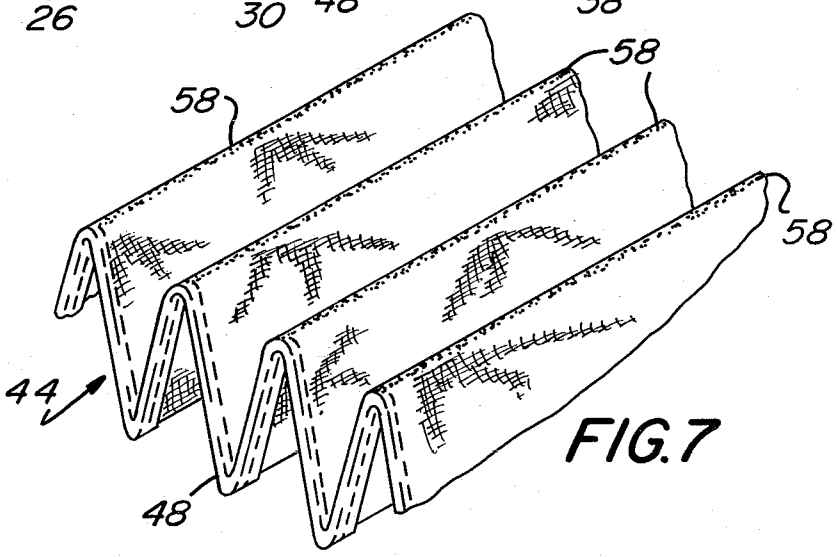
FIG. 7 is a partial perspective view of a pleated fabric having lines printed on the ridges of the pleats.

Thereafter, the blades 26, 30 are separated after removal of the retainers 50. Parting line 49 is no longer angled. See FIG. 6. The space between the blades may be on the order of $\frac{1}{8}$ of an inch to $\frac{1}{4}$ inch. With the frame and fabrics as shown in FIG. 4, the frame is conveyed through a heat curing tunnel for curing the pigment. The spacing between the blades facilitates more rapid heat transfer. After the pigment has been cured, the fabrics 42, 44 are removed from their respective blades. Each of the fabrics 42, 44 will have a line 48 printed on the ridge of the pleat. See FIG. 7 wherein lines 58 are applied to the ridges of the pleats on fabric 44. When the fabric 44 is a woman's skirt, the lines 48 converge upwardly from the hem 48. If desired, adjacent lines 48 may intersect at their upper ends. If desired, the screen 56 may be masked so as to provide lines 58 which are not continuous but represent a line of perforations so as to simulate threads. Lines 58 applied in accordance with the present invention are sharp and of uniform width while preferably being colored with a pigment which contrasts with the color of the fabric. The method of the present invention is simple, can be performed by unskilled labor, and requires little investment for capital equipment.

The present invention may be embodied in other specific forms without departing from the spirit or essential attributes thereof and, accordingly, reference should be made to the appended claims, rather than to the foregoing specification, as indicating the scope of the invention.

We claim:

1. A method of printing lines on pleated fabric or the like comprising the steps of supporting a pleated fabric by a plurality of thin horizontally disposed blades with the ridge of each pleat lying along the upper edge of a blade while the blades are spaced from each other, moving the blades towards each other to a compacted position so that only the ridges of the pleats are exposed above the blades retaining the blades in the compacted position while printing a pigment on said exposed ridges, moving the blades to a spaced apart position so that air may flow between the blades, then curing the pigment on said ridges while the ridges are supported by the blades, and then removing the fabric off the blades.

2. A method in accordance with claim 1 including using fabric wherein the ridges converge from one end toward their opposite end.

3. A method in accordance with claim 1 wherein said retaining step includes using mechanical retainers for retaining the blades in the compacted position.

4. A method in accordance with claim 1 wherein said printing step includes silk screen printing the pigment on the exposed ridges.

5. A method in accordance with claim 1 wherein two discrete pleated fabrics are processed simultaneously on separate sets of said blades, each fabric having a hemmed end, the hemmed ends of the respective fabrics being at opposite ends of a frame supporting said blades, said blades being supported by said frame so that they may be non-parallel.

6. A method of printing lines on pleated fabric or the like comprising providing a frame with a plurality of sets of horizontally disposed thin blades, supporting a first pleated fabric by the blades of the first set with the ridge of each pleat on the first fabric lying along the upper edge of the blade while the blades are spaced from each other, the number of blades of the first set corresponding to the number of pleats in the first fabric, supporting a second fabric on the blades of the second set in the same manner, the number of blades of the second set corresponding to the number of pleats in the second fabric, thereafter moving the blades and the fabrics towards each other to a compacted position so that only the ridges of the pleats on said fabrics are exposed above the associated blades, retaining the blades in the compacted position while printing a pigment on the exposed ridges of the pleats, moving the blades to a spaced apart position so that air may flow between the blades, then curing the pigment on said ridges while the ridges are supported by the blades in their opened position, then removing the fabrics off said blades.

7. A method in accordance with claim 6 including providing the fabrics with hems along one edge, locating the hem of the first fabric along one end of the frame, and locating the hem on the other fabric along the opposite end of the frame, whereby the combined thickness of the ends of the fabrics are substantially identical.

8. A method in accordance with claim 7 including using end blades between which the fabrics are located, the end blades being substantially thicker and more rigid than the remaining blades.

9. A method in accordance with claim 6 including supporting the blades in a manner so that they may be moved between parallel and non-parallel positions.

10. Apparatus for printing lines of pigment on pleated fabric or the like comprising a rectangular frame having parallel sides and parallel ends, a pair of guide rods extending between the sides, each guide rod being adjacent one end, a plurality of thin blades for supporting a pleated fabric with the ridge of each pleat lying along the upper edge of a respective blade and supported by said guide rods in a manner so that the blades may be moved between parallel and non-parallel positions, a pair of end blades between which the remaining blades are located, the end blades being substantially thicker and more rigid than the blades therebetween, at least one of the end blades being movable toward and away from the other end blade to compact said blades so that only the ridges of the pleats are exposed above the blades, retainer means for retaining all of the blades in a compacted position, and means for printing on said exposed ridges while said blades are in a compacted position.

* * * * *